US012612785B2

(12) United States Patent
Flett

(10) Patent No.: US 12,612,785 B2
(45) Date of Patent: Apr. 28, 2026

(54) WATERPROOFING BUILDING PRODUCT

(71) Applicant: SCOTT FLETT ARCHITECTURE WORKSHOP PTY LTD, Baulkham Hills (AU)

(72) Inventor: Scott Flett, Baulkham Hills (AU)

(73) Assignee: SCOTT FLETT ARCHITECTURE WORKSHOP PTY LTD, Baulkham Hills (AU)

( * ) Notice: Subject to any disclaimer, the term of this patent is extended or adjusted under 35 U.S.C. 154(b) by 994 days.

(21) Appl. No.: 17/627,145

(22) PCT Filed: Jul. 15, 2020

(86) PCT No.: PCT/AU2020/050728
§ 371 (c)(1),
(2) Date: Jan. 14, 2022

(87) PCT Pub. No.: WO2021/007616
PCT Pub. Date: Jan. 21, 2021

(65) Prior Publication Data

US 2022/0251844 A1 Aug. 11, 2022

(30) Foreign Application Priority Data

Jul. 16, 2019 (AU) ..... 2019902510

(51) Int. Cl.
*E04D 1/36* (2006.01)
*E04D 3/38* (2006.01)
(Continued)

(52) U.S. Cl.
CPC ..... *E04D 1/36* (2013.01); *E04D 3/38* (2013.01); *E04D 2001/305* (2013.01); *E04D 2013/0454* (2013.01); *E04D 2013/0468* (2013.01)

(58) Field of Classification Search
CPC ..... E04D 1/30; E04D 1/36; E04D 1/3402; E04D 1/3405; E04D 2001/302;
(Continued)

(56) References Cited

U.S. PATENT DOCUMENTS 993,281 A * 5/1911 Todd ..... E04D 3/363 52/537
4,559,753 A * 12/1985 Brueske ..... E04D 13/0315 52/200
(Continued)

FOREIGN PATENT DOCUMENTS

CN 102352670 B 6/2014
CN 105863172 A 8/2016
(Continued)

OTHER PUBLICATIONS

International Search Report (ISR) which issued on PCT/AU2020/050728.

*Primary Examiner* — Jessica L Laux
(74) *Attorney, Agent, or Firm* — Thomas Joseph; OGC Law, LLC

(57) ABSTRACT

In one aspect there is disclosed a waterproofing building product (10) for use in waterproofing a joint (12) between a first and second roofing panel (14, 16). The waterproofing building product (10) includes an overlapping section (18) operatively adapted to overlap a portion of the first roofing panel (14) and an underlapping section (20) operatively adapted to underlap a portion of the second roofing panel (16). The waterproofing building product (10) further includes a transition section (22) located between the overlapping section (18) and the underlapping section (20) and connecting the overlapping section (18) with the underlapping section (20).

7 Claims, 4 Drawing Sheets

(51) Int. Cl.
*E04D 1/30* (2006.01)
*E04D 13/04* (2006.01)

(58) Field of Classification Search
CPC ..... E04D 2001/304; E04D 2001/305; E04D 2001/306; E04D 3/24; E04D 3/266; E04D 3/38; E04D 13/15; E04D 13/157; E04D 13/158; E04D 13/1585
See application file for complete search history.

(56) References Cited

U.S. PATENT DOCUMENTS 5,074,093 A * 12/1991 Meadows ..... E04D 3/32 52/537
5,323,576 A * 6/1994 Gumpert ..... E04D 13/03 52/72
5,584,155 A * 12/1996 Watanabe ..... E04D 3/366 52/538
5,642,596 A 7/1997 Waddlington
6,148,578 A 11/2000 Nowacek et al.
6,301,853 B1 * 10/2001 Simpson ..... E04D 3/362 52/550
2013/0111831 A1 5/2013 Jenkins et al.

FOREIGN PATENT DOCUMENTS

WO WO-2014160362 A1 * 10/2014 ..... B27N 1/02
WO WO-2017212203 A1 * 12/2017

* cited by examiner

WATERPROOFING BUILDING PRODUCT

CROSS REFERENCE TO RELATED APPLICATIONS

The present application is a U.S. national stage application of PCT International Application No. PCT/AU2020/050728, filed Jul. 15, 2020, and published as PCT Publication WO/2021/007616 on Jan. 21, 2021, which claims priority to Australian Application No. AU 2019902510, filed on Jul. 16, 2019. The disclosures of all the foregoing applications are hereby incorporated by reference in their entirety into the present application.

FIELD

The invention concerns a waterproofing building product, particularly but not exclusively, a waterproofing building product in the form of roof flashing.

BACKGROUND

Flashing refers to impervious building products installed to prevent rainwater seeping into a structure through a joint. Flashing serves to direct the gravity flow of water away from the building fabric to prevent water penetration at roof junctions, gutter junctions, wall junctions and roof penetrations such as chimneys and parapet walls. In the past flashing was produced from lead sheeting. Lead is soft and easily worked to various shapes. However, due to cost and fears concerning lead contamination alternative materials such as plastics, steel and aluminium have in more recent times been employed for producing flashing. In Australia the most common form of flashing currently in use include crush fold Colorbond™ steel, crush fold Zincalume™ steel, crush fold aluminium and crush fold galvanised iron.

Although flashings may be found in many external areas of a building, the most common area where flashings may be found is the roof of a building. External junctions are generally required by building codes to have a flashing. The most common flashings include apron flashing, barge flashing, ridge flashing, valley flashing, pitch adaptors, box gutters, back tray, skylight trims, external corners, internal corners, fascia covers and parapet caps. The purpose of roof flashings is primarily to maintain a watertight roof. Without flashing rainwater would seep through joints and into the interior of the building. Water penetrating a roof can damage the structural integrity of the building, cause material damage, and can affect common building concerns relating to condensation, mold and fungus growth.

The strength of sheet metals can be increased by corrugating or folding the material to make ridges and grooves. Such waved construction leads to increased strength over a shorter surface area. In particular, a corrugated profile adds strength to lightweight materials. In Australia the most common form of sheet metal is high tensile steel of 0.42-0.6 base metal thickness (BMT) which has a protective Colorbond™ paint applied. This product is sturdy enough to be employed as roofing panels and withstand Australia's harsh climate. Typically, corrugated roofing panels are joined by having end portions of adjoining portions overlap. One drawback of existing overlapping joints is that it is not easy to change the direction of a roof profile. While spring curving and pre-curving roof sheeting offer some beneficial features, sharp turns remain problematic. Furthermore, roofs often have complex shapes. Complex shapes make fully lapped flashings challenging and make installing a weatherproof sealant difficult. This often requires specialist skilled roofing trades people with resulting additional labour costs.

OBJECT

It is an object of the present invention to provide a waterproofing building product which can be used as an alternative to flashing currently employed to waterproof roofs.

SUMMARY

According to a first aspect of the present invention there is disclosed herein a waterproofing building product for use in waterproofing a joint between a first and second roofing panel, the waterproofing building product including:

- an overlapping section operatively adapted to overlap a portion of the first roofing panel;
- an underlapping section operatively adapted to underlap a portion of the second roofing panel; and
- a transition section (i) located between the overlapping section and the underlapping section, and (ii) connecting the overlapping section with the underlapping section.

Preferably the waterproofing building product extends longitudinally between a first end and a second end.

Preferably the overlapping section at the first end includes a ridge overlapping section operatively adapted to overlap a first ridge of the first roofing panel.

Preferably the ridge overlapping section defines a ridge recess operatively adapted to receive the first ridge of the first roofing panel.

Preferably the overlapping section includes a transverse groove overlapping section operatively adapted to overlap a groove of the first roofing panel, the groove overlapping section longitudinally extending between the ridge overlapping section and the second end.

Preferably the underlapping section at the first end includes a ridge underlapping section operatively adapted to underlap a first ridge of the second roofing panel.

Preferably the underlapping section includes a transverse groove underlapping section operatively adapted to underlap a groove of the second roofing panel, the groove underlapping section extending longitudinally between the ridge underlapping section and the second end.

Preferably the ridge underlapping section defines a ridge insertion portion operatively adapted to locate within a first panel recess defined by the second roofing panel.

Preferably the overlapping section includes a transverse overlapping flange at the second end of the waterproofing building product operatively adapted to be located adjacent a second ridge of the first roofing panel.

Preferably the underlapping section includes a transverse underlapping flange at the second end of the waterproofing building product operatively adapted to be received within a second panel recess defined by the second roofing panel.

In an embodiment the groove overlapping section includes a groove overlapping face having a first groove overlapping width at the first end and a second groove overlapping width at the second end, wherein the magnitude of the first groove overlapping width is different to the magnitude of the second groove overlapping width.

In an embodiment the groove underlapping section includes a groove underlapping face having a first groove underlapping width at the first end and a second groove underlapping width at the second end wherein the magnitude of the first groove underlapping width is different to the magnitude of the second groove underlapping width.

Preferably the waterproofing building product includes a draining cavity.

Preferably the waterproofing building product is produced by an additive manufacturing method.

Preferably the waterproofing building product is produced by three-dimensional printing.

According to a second aspect of the present invention there is disclosed herein a waterproofing building product for use in waterproofing a joint between a first and second building component, the waterproofing building product including:

- an overlapping section operatively adapted to overlap a portion of the first building component;
- an underlapping section operatively adapted to underlap a portion of the second building component; and
- a transition section (i) located between the overlapping section and the underlapping section, and (ii) connecting the overlapping section with the underlapping section.

According to a third aspect of the present invention there is disclosed herein a waterproofing building product for use in waterproofing a joint between a first and second roofing panel, the waterproofing building product including:

- a first underlapping section operatively adapted to underlap a portion of the first roofing panel;
- a second underlapping section operatively adapted to underlap a portion of the second roofing panel; and
- a transition section located between the first underlapping section and the second underlapping section and connecting the first underlapping section with the second underlapping section.

According to a fourth aspect of the present invention there is disclosed herein a waterproofing building product for use in waterproofing a joint between a first and second roofing panel, the waterproofing building product including:

- a first overlapping section operatively adapted to overlap a portion of the first roofing panel;
- a second overlapping section operatively adapted to overlap a portion of the second roofing panel; and
- a transition section located between the first overlapping section and the second overlapping section and connecting the first overlapping section with the second overlapping section.

In a fifth aspect there is provided a method of manufacturing a waterproofing building product according to the first aspect produced by way of additive manufacturing.

BRIEF DESCRIPTION OF THE DRAWINGS

Preferred embodiments of the present invention will be described hereinafter, by way of examples only, with reference to the accompany drawings, in which.

DESCRIPTION OF PREFERRED EMBODIMENTS

Figure 1:
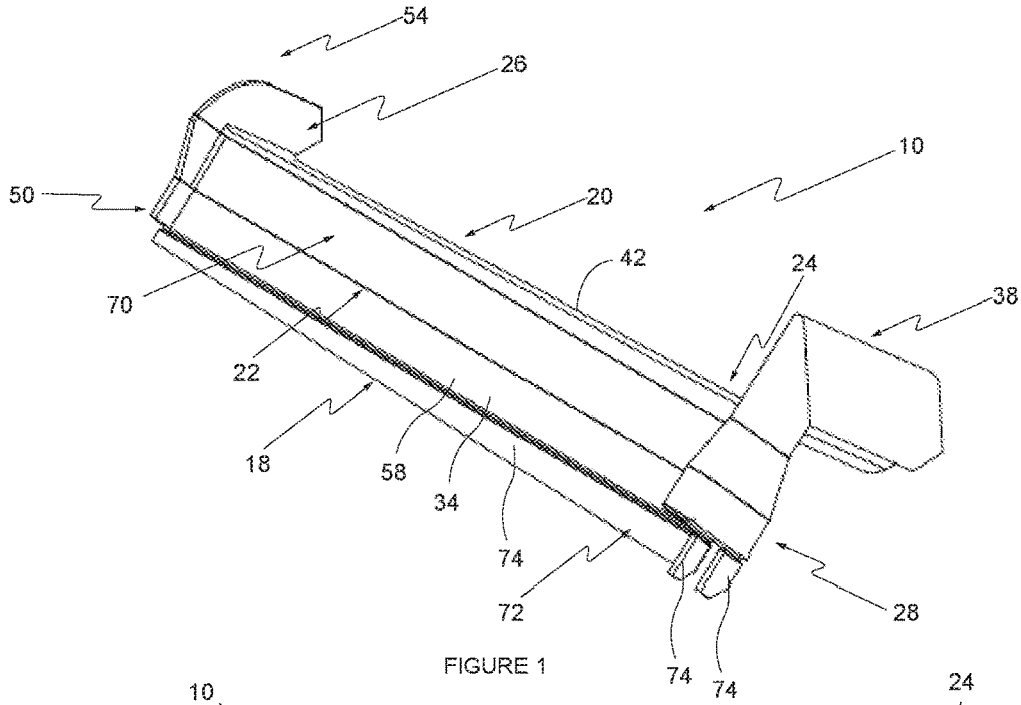
FIG. 1 is a perspective view of a first embodiment waterproofing building product.
Figure 2:
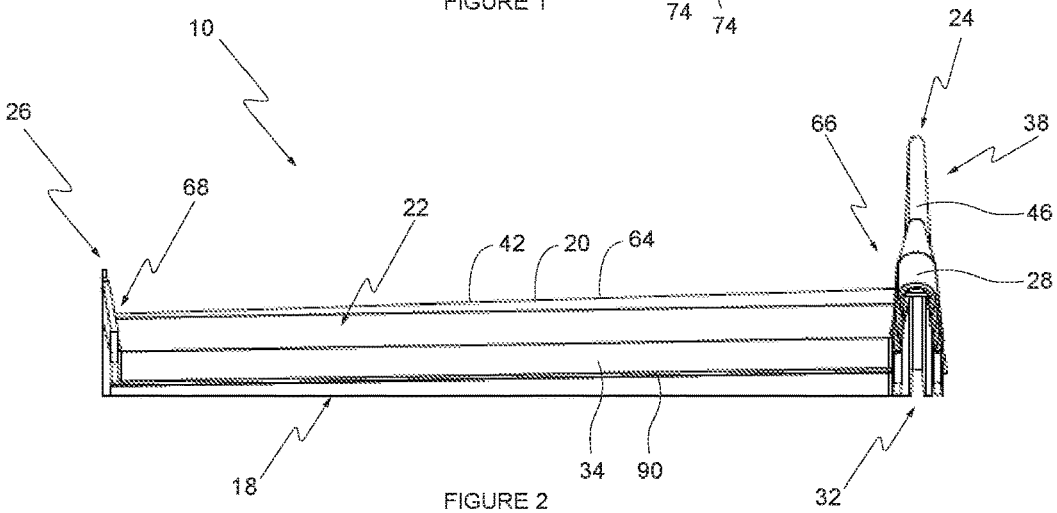
FIG. 2 is a front view of the waterproofing building product of FIG. 1.
Figure 3:
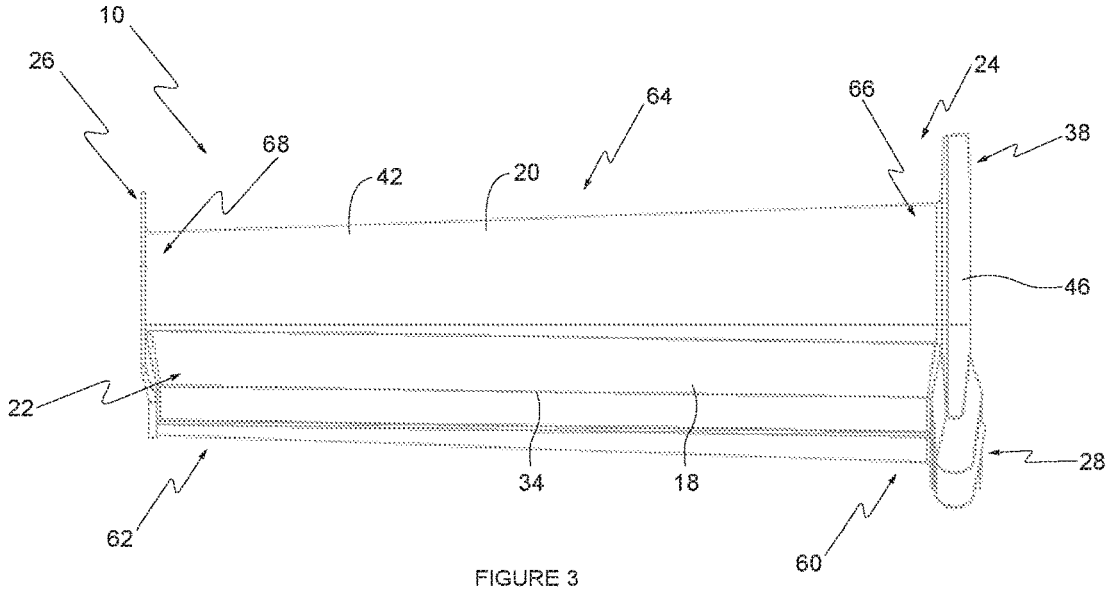
FIG. 3 is a plan view of the waterproofing building product of FIG. 1.
Figure 4:
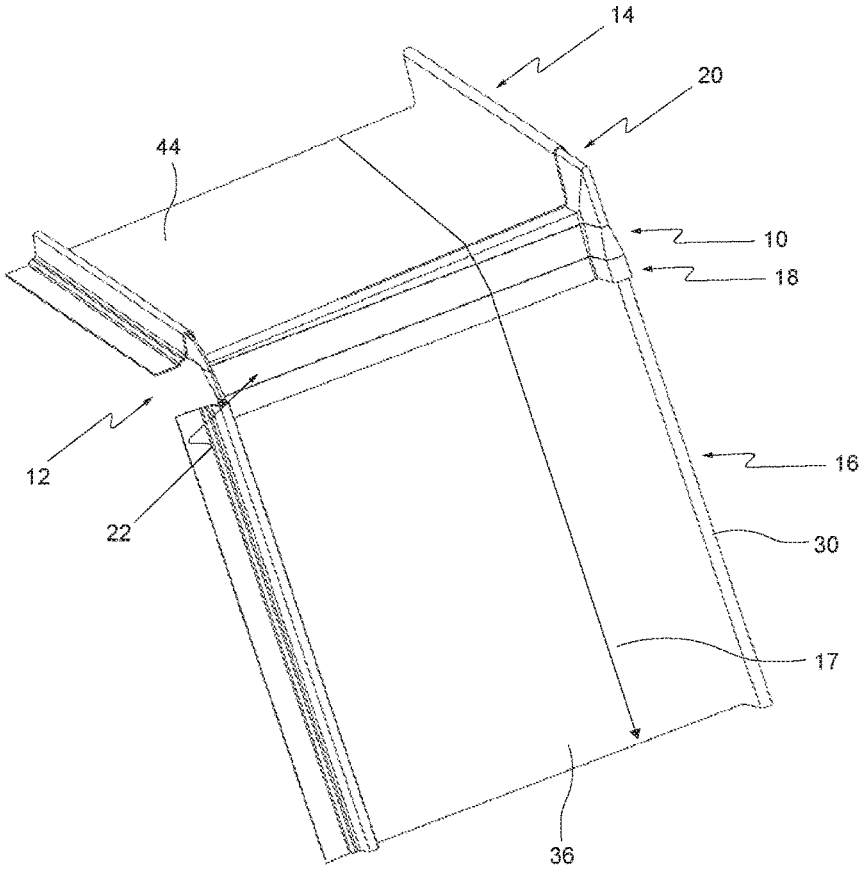
FIG. 4 is a perspective view of the embodiment waterproofing building product of FIG. 1 employed to connect a first and second roofing panel.
Figure 5:
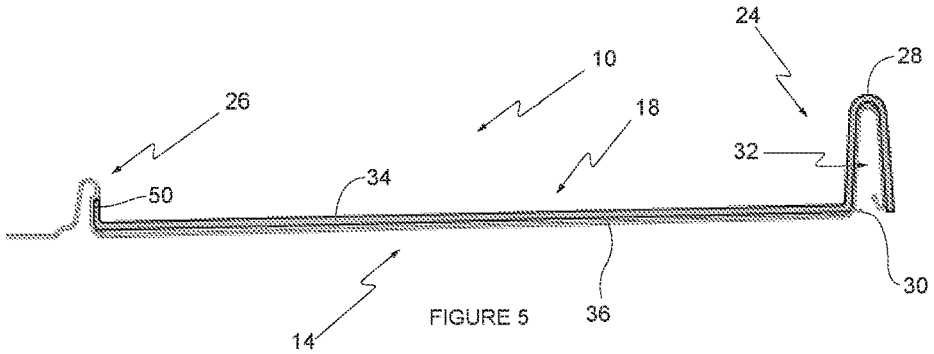
FIG. 5 is a cross-sectional view of a portion of the waterproofing building product of FIG. 1 overlapping a portion of the first roofing panel.
Figure 6:
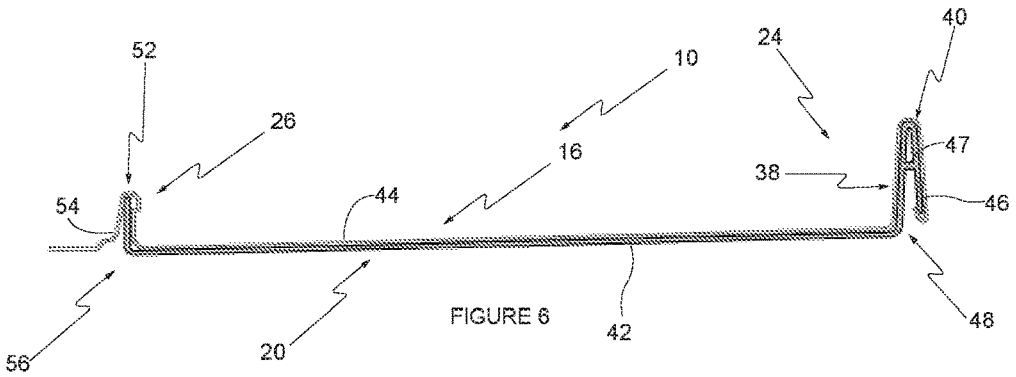
FIG. 6 is a cross-sectional view of a portion of the waterproofing building product of FIG. 1 underlapping a portion of the second roofing panel.

FIGS. 1 to 6 show a waterproofing building product, generally indicated with the reference numeral 10, for use in waterproofing a joint 12 between an operative upper first roofing panel 14 and an operative lower second roofing panel 16. In this embodiment the first and second roofing panels 14, 16 are Lysaght Enseam® panels. Waterflow along the waterproofing building product 10 is indicated with the reference numeral 17.

Although the below described embodiments refer particularly to roofing panels, it will be appreciated that the invention is not limited to that application and can be employed to provide waterproofing between various other types of building components. The waterproofing building product 10 includes an overlapping section 18 operatively adapted to overlap a portion of the second roofing panel 16. The waterproofing building product 10 further includes an underlapping section 20 operatively adapted to underlap a portion of the first roofing panel 14. The waterproofing building product 10 further includes a transition section 22 located between the overlapping section 18 and the underlying section 20 which connect the overlapping section 18 to the underlying section 20.

The waterproofing building product 10 longitudinally extends between a first end 24 and a second end 26. The overlapping section 18 at the first end 24 includes a ridge overlapping section 28 operatively adapted to overlap a first ridge 30 of the second roofing panel 16, shown in FIG. 5. The ridge overlapping section 30 defines a ridge recess 32 operatively adapted to receive the first ridge 30 of the second roofing panel 16. The overlapping section 18 includes a transverse groove overlapping section 34 operatively adapted to overlap a groove 36 of the second roofing panel 16. As shown the groove overlapping section 34 extends longitudinally between the ridge overlapping section at the first end 24 and the second end 26.

The underlapping section 20 at the first end 24 includes a ridge underlapping section 38 operatively adapted to underlap a first ridge 40 of the first roofing panel 14. The underlapping section 20 includes a transverse groove underlapping section 42 operatively adapted to underlap a groove 44 of the first roofing panel 14. The groove underlapping section 42 extends longitudinally between the ridge underlapping section 38 and the second end 26. The ridge underlapping section 38 defines a ridge insertion portion 46 operatively adapted to be located within a first panel recess 48 defined by the first roofing panel 14. The ridge insertion portion 46 includes a transverse support rib 47.

The overlapping section 18 includes a transverse overlapping flange 50 at the second end 26 of the waterproofing building product 10. The overlapping flange 50 is operatively adapted to be located adjacent a second ridge 52 of the second roofing panel 16.

The underlapping section 18 includes a transverse underlapping flange 54 at the second end 26 of the waterproofing building product 10. The underlapping flange 54 is operatively adapted to be received within a second panel recess 56 defined by the first roofing panel 14.

In the embodiment waterproofing building product 10 the groove overlapping section 34 includes a groove overlapping face 58 having a first groove overlapping width 60 at the first end 24 and a second groove overlapping width 62 at the second end 26. It will be noted that the magnitude of the first groove overlapping width 60 is different, here larger, than the magnitude of the second groove overlapping width 62. The groove underlapping section 38, in turn, includes a groove underlapping face 64 having a first groove underlapping width 66 at the first end 24 and a second groove underlapping width 68 at the second end 26. In this embodiment waterproofing building product 10 the magnitude of the first groove underlapping width 66 is different, here larger, than the magnitude of the second groove underlapping width 68.

The differences in width magnitude enables the building product 10 to accommodate multi-axial changes in direction of roofing panels, that is, changes in angle and rotation as dictated by a particular roofing profile. In this embodiment the first and second Lysaght Enseam® panels 14, 16 will exhibit an amount of rotation after fixing. Such rotation is catered for by the embodiment building product 10. Further, to ensure an aesthetically pleasing appearance the waterproofing building product 10 at the overlapping section 18 includes rows of snap-off points 74 to enable a portion of the overlapping section 18 to be snapped off. The underlapping section 20 is not perpendicularly offset relative to the first roofing panel 14. However, as this offset is hidden from view behind the first roofing panel 14, snap-off points are not provided.

The embodiment waterproofing building product 10 is produced by an additive manufacturing method, particularly three-dimensional printing. It is, however, envisaged that the printed waterproofing building product 10 could be used to create a mould for use in an injection moulding process. The embodiment waterproofing building product is printed according to the specific profile of the first and second roofing panels 14, 16 to enable a beneficial watertight seal between those roofing panels as it has a fully lapped joint, an integrated weep hole with additional enhanced silicone application. Three-dimensional printing offers unlimited scope to match existing or future roof profiles. The waterproofing building product 10 can be configured to corrugated iron or a profile sold under the trade mark KLIP-LOCK™. Those are likely the most common roof sheet profiles in use in Australia. The waterproofing building product 10 could also be made to more traditional metal cladding profiles and other roofing material.

The embodiment waterproofing building product 10 is produced from Acrylonitrile styrene acrylate (ASA) which provides non-toxic monolithic robustness as well UV and thermal stability. It will of course be appreciated that a range of other polymers could be used for producing the waterproofing building product 10, for example Acrylonitrile Butadiene Styrene (ABS).

In a non-illustrated embodiment a waterproofing building product is provided for use with guttering. In this embodiment the waterproofing building product includes a first underlapping section operatively adapted to underlap a portion of a first roofing panel and a second underlapping section operatively adapted to underlap a portion of a second roofing panel. This embodiment waterproofing building product includes a transition section located between the first underlapping section and the second underlapping section and connecting the first underlapping section with the second underlapping section.

In a non-illustrated embodiment a waterproofing building product is provided for use as ridge capping. In this embodiment the waterproofing building product includes a first overlapping section operatively adapted to overlap a portion of a first roofing panel and a second overlapping section operatively adapted to overlap a portion of a second roofing panel. This embodiment waterproofing building product includes a transition section located between the first overlapping section and the second overlapping section and connects the first overlapping section with the second overlapping section.

It is envisaged that the embodiment waterproofing building product provides alternative aesthetic features. The embodiment waterproofing building product can be painted to match roofing colour. It is also envisaged that the embodiment waterproofing building product is able to be installed without the need for skilled roofing tradespersons.

When using a waterproofing building product to change direction, it is possible to reduce leaf loading on gutters. Reducing the amount of leaves in gutters can deter leakage and also reduce the risk of bushfires. In this application the waterproofing building product is located at the end of a roof edge and the gutter located beneath the waterproofing building product. In one typical installation the gutter is located 600 mm below the embodiment waterproofing building product. Leaves moving down the roofing will tend to reach the waterproofing building product and tend to drift past the gutter below, while water will flow towards the waterproofing building product and cascade into the gutter.

In use, a non-illustrated silicone bead will be located at a position indicated with the reference numeral 70 in FIG. 1. The waterproofing building product 10 includes a non-illustrated integrated weep hole drainage cavity so as to feed water through the waterproofing building product 10 to a weep hole outlet 72. This feature is made possible as a result of the waterproofing building product 10 being produced by way of three-dimensional printing. The integrated hole drainage cavity in effect creates a porous layer in between the an outside and inside surface of the waterproofing building product 10. In this instance, the porosity of the internal infill structure creates a 'water aquifer' so that should the waterproofing building product 10 experience weakness, as is common with any silicone application, then an additional route is provided for water to pass through the waterproofing building product 10. That feature provides enhanced protection against hydro-static pressure (such as prevailing winds and stormy weather), enhanced protection against capillary action (common on metal to metal overlaps), and enhanced protection against silicone application failure.

Figure 7:
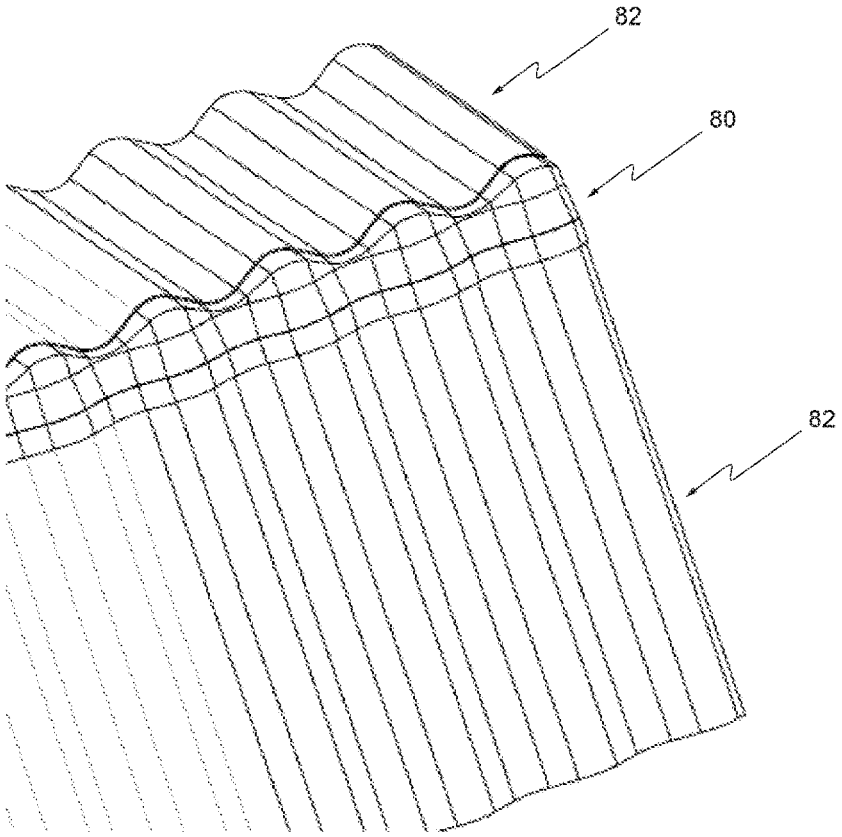
FIG. 7 is a perspective view of a second embodiment waterproofing building product.
Figure 8:
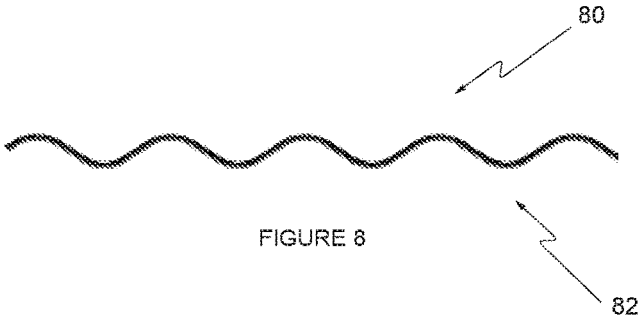
FIG. 8 is a cross-sectional view of a portion of the waterproofing building product of FIG. 7 overlapping a portion of the first roofing panel.
Figure 9:
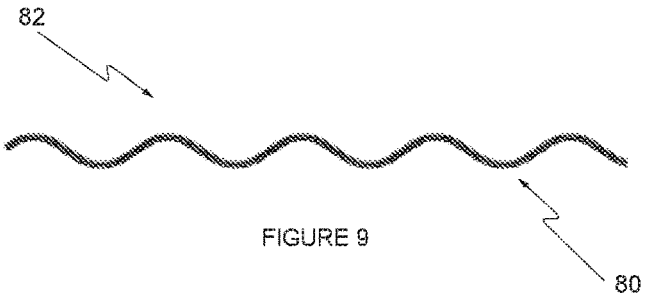
FIG. 9 is a cross-sectional view of a portion of the waterproofing building product of FIG. 7 underlapping a portion of the second roofing panel.
Figure 10:
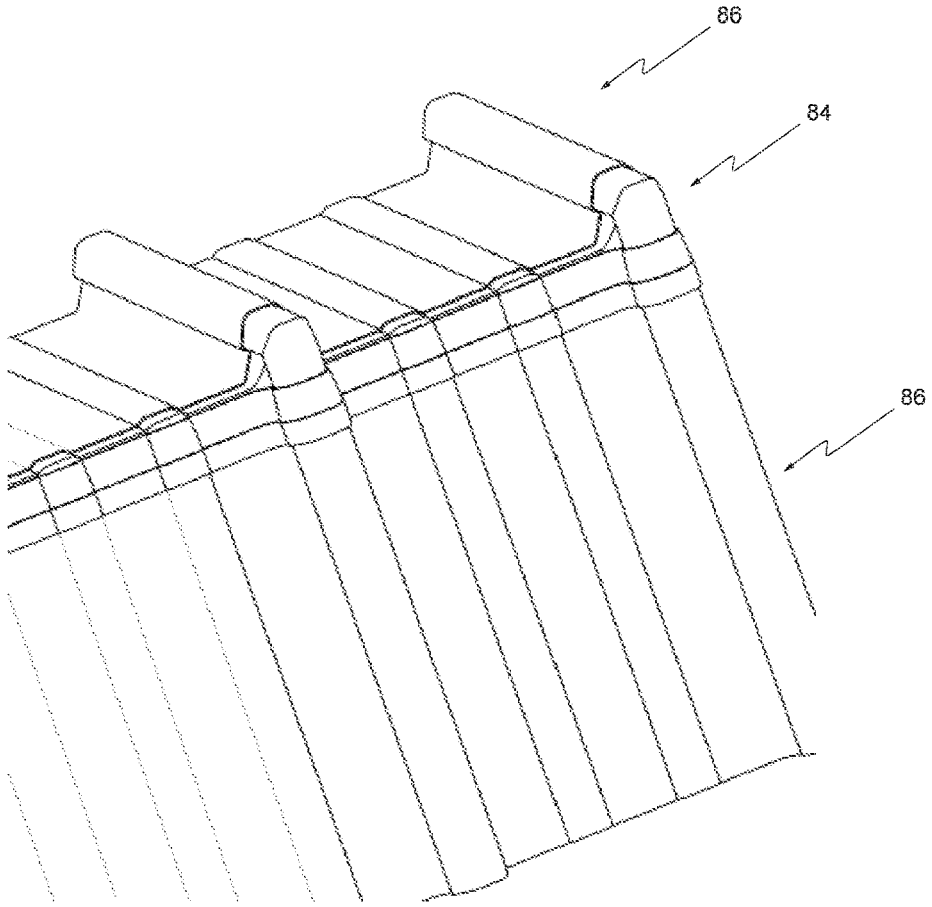
FIG. 10 is a perspective view of a third embodiment waterproofing building product.
Figure 11:
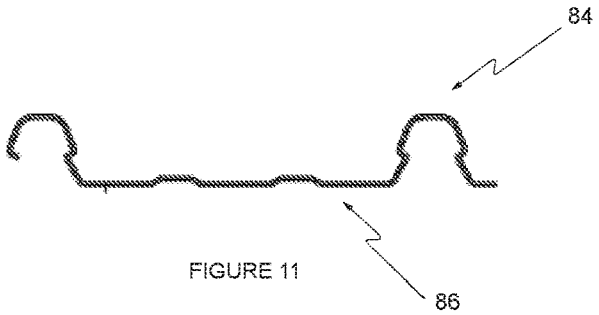
FIG. 11 is a cross-sectional view of a portion of the waterproofing building product of FIG. 10 overlapping a portion of the first roofing panel.
Figure 12:
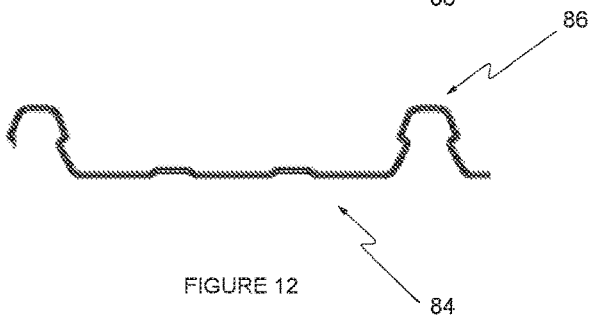
FIG. 12 is a cross-sectional view of a portion of the waterproofing building product of FIG. 10 underlapping a portion of the second roofing panel.

Embodiment waterproofing building products could be produced with various profiles/shapes to accommodate different roofing profiles. FIGS. 7 to 9, for example, show an embodiment waterproofing building product 80 shaped to be employed with a CUSTOM ORB® profile 82. FIGS. 10 to 12 show an embodiment building product 84 shaped to be employed with a KLIP-LOK® profile 86. It would be appreciated that embodiment waterproofing building products could be produced to accommodate a range of other non-illustrated building products.

Although the invention has been described with reference to specific examples, it will be appreciated by those skilled in the art that the invention may be embodied in many other forms.

KEY TO REFERENCE NUMERALS

10 Waterproofing building product
12 Joint
14 Operative upper first roofing panel
16 Operative lower second roofing panel
17 Waterflow
18 Overlapping section
20 Underlapping section
22 Transition section
24 First end
26 Second end
28 Ridge overlapping section
30 First ridge
32 Ridge recess
34 Transverse groove overlapping section
36 Groove
38 Ridge underlapping section
40 First ridge
42 Transverse groove underlapping section
44 Groove
46 Ridge insertion portion
47 Transverse support rib
48 First panel recess
50 Transverse overlapping flange
52 Second ridge
54 Transverse underlapping flange
56 Second panel recess
58 Groove overlapping face
60 First groove overlapping width
62 Second groove overlapping width
64 Groove underlapping face
66 First groove underlapping width
68 Second groove underlapping width
70 Silicone bead position
72 Weep hole outlet
80 Waterproofing building product
82 CUSTOM ORB® profile
84 Waterproofing building product
86 KLIP-LOK® profile

The invention claimed is:

1. A waterproofing building product for use in waterproofing a joint between a first and second roofing panel, the waterproofing building product longitudinally extending between a first longitudinal end and a second longitudinal end and including:

an overlapping section operatively adapted to overlap, in use, a portion of the first roofing panel;

an underlapping section operatively adapted to underlap, in use, a portion of the second roofing panel; and a transition section located between the overlapping section and the underlapping section and connecting the overlapping section with the underlapping section;

wherein the overlapping section at the first longitudinal end includes a ridge overlapping section operatively adapted to overlap a first ridge of the first roofing panel;

wherein the ridge overlapping section defines a ridge recess operatively adapted to receive the first ridge of the first roofing panel;

wherein the overlapping section includes a transverse groove overlapping section operatively adapted to overlap, in use, a groove of the first roofing panel, the groove overlapping section longitudinally extending between the ridge overlapping section and the second longitudinal end;

wherein the underlapping section at the first longitudinal end includes a ridge underlapping section operatively adapted to underlap, in use, a first ridge of the second roofing panel;

wherein the underlapping section includes a transverse groove underlapping section operatively adapted to underlap, in use, a groove of the second roofing panel, the groove underlapping section longitudinally extending between the ridge underlapping section and the second longitudinal end;

wherein the ridge underlapping section defines a ridge insertion portion operatively adapted to be located, in use, within a first panel recess defined by the second roofing panel;

wherein the overlapping section includes a transverse overlapping flange at the second longitudinal end of the waterproofing building product operatively adapted to be located, in use, adjacent a second ridge of the first roofing panel;

wherein the underlapping section includes a transverse underlapping flange at the second longitudinal end of the waterproofing building product operatively adapted to be received, in use within a second panel recess defined by the second roofing panel; and wherein the groove overlapping section includes a groove overlapping face having a first groove overlapping width at the first longitudinal end and a second groove overlapping width at the second longitudinal end wherein the magnitude of the first groove overlapping width is different to the magnitude of the second groove overlapping width.

2. A waterproofing building product according to claim 1, wherein the groove underlapping section includes a groove underlapping face having a first groove underlapping width at the first end and a second groove underlapping width at the second end wherein the magnitude of the first groove underlapping width is different to the magnitude of the second groove underlapping width.

3. A waterproofing building product according to claim 2, wherein the waterproofing building product includes a draining cavity.

4. A waterproofing building product according to claim 3, wherein the waterproofing building product is produced by an additive manufacturing method.

5. A waterproofing building product according to claim 4, wherein the waterproofing building product is produced by three-dimensional printing.

6. A waterproofing building product according to claim 1, wherein the waterproofing building product is produced by additive manufacturing.

7. A waterproofing building product according to claim 5, wherein the waterproofing building product is produced by additive manufacturing.

* * * * *